US008651769B2

(12) United States Patent
Hosp

(10) Patent No.: US 8,651,769 B2
(45) Date of Patent: Feb. 18, 2014

(54) FRICTION BOLT

(75) Inventor: Michael Hosp, Villach (AT)

(73) Assignee: Atlas Copco MAI GmbH, Feistritz an der Drau (AT)

( * ) Notice: Subject to any disclaimer, the term of this patent is extended or adjusted under 35 U.S.C. 154(b) by 0 days.

(21) Appl. No.: 13/497,355

(22) PCT Filed: Jul. 1, 2010

(86) PCT No.: PCT/AT2010/000240
§ 371 (c)(1),
(2), (4) Date: Mar. 21, 2012

(87) PCT Pub. No.: WO2011/035353
PCT Pub. Date: Mar. 31, 2011

(65) Prior Publication Data

US 2012/0308310 A1 Dec. 6, 2012

(30) Foreign Application Priority Data

Sep. 24, 2009 (AT) ..... A 1501/2009

(51) Int. Cl.
*E21D 21/00* (2006.01)
*E21D 20/00* (2006.01)

(52) U.S. Cl.
USPC ..... 405/259.3

(58) Field of Classification Search
USPC ..... 405/259.1, 259.3
See application file for complete search history.

(56) References Cited

U.S. PATENT DOCUMENTS

| | | | | |
|---|---|---|---|---|
| 3,774,296 | A * | 11/1973 | Clay | 228/184 |
| 4,459,067 | A * | 7/1984 | Skogberg et al. | 405/259.3 |
| 4,487,528 | A | 12/1984 | Skogberg | |
| 4,954,017 | A | 9/1990 | Davis et al. | |
| 5,997,219 | A * | 12/1999 | Krzysztalowicz et al. | 405/259.3 |
| 7,891,911 | B2 * | 2/2011 | Tschernuth et al. | 405/259.3 |
| 2007/0217869 | A1 | 9/2007 | Dawe | |

FOREIGN PATENT DOCUMENTS

| | | |
|---|---|---|
| WO | 2005/073510 | 8/2005 |
| WO | 2005/119009 | 12/2005 |
| WO | 2006/066288 | 6/2006 |
| WO | 2007/023363 | 3/2007 |

(Continued)

OTHER PUBLICATIONS

International Search Report dated Feb. 17, 2012, corresponding to PCT/AT2010/000240.

(Continued)

*Primary Examiner* — Frederick L Lagman
(74) *Attorney, Agent, or Firm* — Young & Thompson

(57) ABSTRACT

A tube (1) of a friction bolt has an outer part (3) and an inner part (5) folded inward and a gap (7) extending in the longitudinal direction of the tube, at which gap the outer part transitions into the inner part. The lateral wall areas (9) of the inner part are flat and have a shape in which the free space between the outer and inner parts is substantially lenticular as in known tubes. The bottom (15) of the inner part lies against the outer part, and the weld (13) is arranged at a lateral offset from the plane of symmetry (11) as the area where the bottom lies against the outer part of the tube. Finally, the radii of curvature (R3) in the area of the transitions (4) from the outer part into the inner part of the tube are greater than in known tubes.

15 Claims, 3 Drawing Sheets

(56) References Cited

FOREIGN PATENT DOCUMENTS

| | | |
|---|---|---|
| WO | 2007/082319 | 7/2007 |
| WO | 2008/019409 | 2/2008 |
| WO | 2009/066246 | 5/2009 |

OTHER PUBLICATIONS

Austrian Office Action dated Mar. 12, 2010, corresponding to Foreign Priority Application No. A 1501/2009.

* cited by examiner

Prior Art

FRICTION BOLT

BACKGROUND OF THE INVENTION

1. Field of the Invention

The invention relates to a friction bolt.

2. Description of the Related Art

Such friction bolts (trademark designation of the Atlas Copco "Swellex") are known. For example, reference can be made to U.S. Pat. No. 4,459,067 A, WO 2005/073510 A, WO 2005/119009 A, WO 2006/066288 A and WO 2008/019409 A.

The known friction bolts are roof bolts (rock bolts), which have a tube that is folded inward in the longitudinal direction, which tube is introduced into a borehole and is widened by increasing the pressure inside the folded tube, so that the outside surface of the tube is applied to the inside surface of the borehole and the bolt is thus fixed (positively) in the borehole.

The known friction bolts have a cross-sectional shape that is reproduced in FIG. 1. In this known cross-sectional shape, the inward-folded part of the tube has a shape that is essentially concentric to the (circular) shape of the outer part of the tube. In addition, an undercut is produced by the narrow gap at the beginning (root) of the inward-folded part of the tube and the widening of the inward-folded part. This undercut is problematic in many respects.

BRIEF SUMMARY OF THE INVENTION

The object of the invention is to propose an improved cross-sectional shape for friction bolts that has advantages relative to the known friction bolts.

Preferred and advantageous configurations of the invention are subjects of the subclaims.

Since, in the friction bolt according to the invention, a cross-sectional shape is selected in which the inward-formed part of the tube does not extend concentrically to the outer part of the tube but rather deviates inward from this concentric shape, a flatter shape of the lateral areas of the inward-folded part of the tube is produced. Thus, undercut areas are avoided, and advantageous, new properties of the friction bolt according to the invention are produced.

Additional details and features of the invention follow from the description of a preferred embodiment below.

BRIEF DESCRIPTION OF THE DRAWING FIGURES

Here:

DETAILED DESCRIPTION OF THE INVENTION

Figure 1:
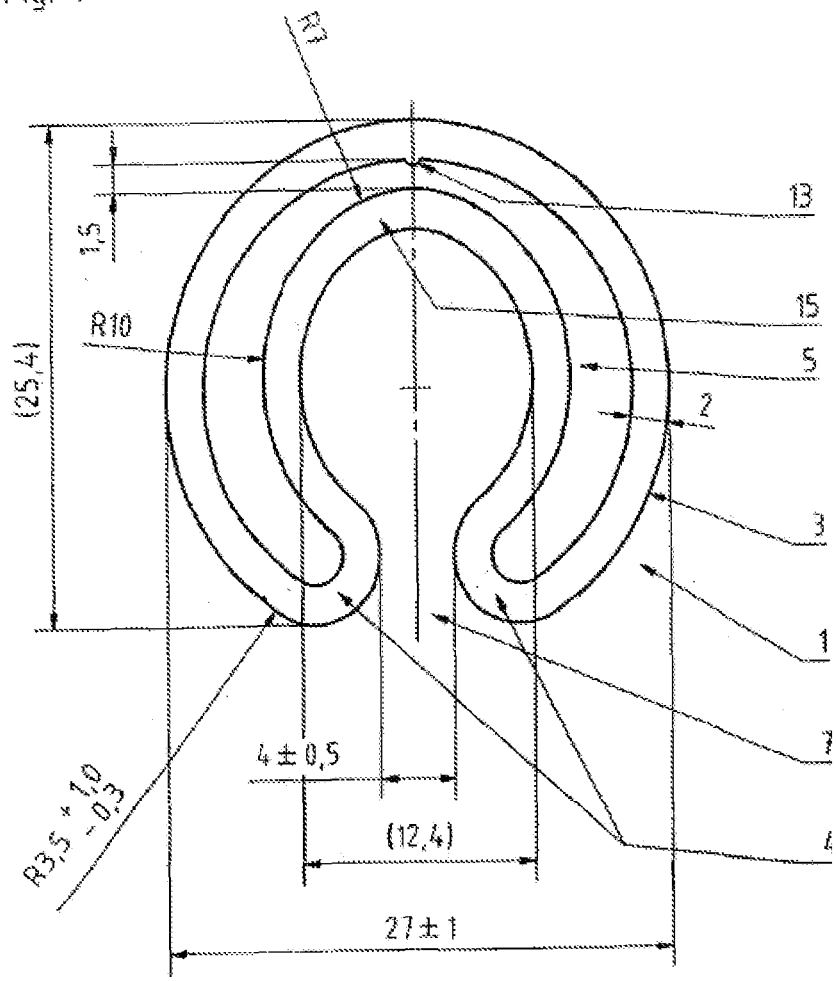
FIG. 1 shows the cross-sectional shape of a known friction bolt (non-widened state)

The tube 1 of a known friction bolt that is shown in the non-widened state in FIG. 1 is a tube 1 that is produced by roll forming and that has a longitudinal weld 13. The outer part 3 of the tube 1 is designed essentially circular in cross-section. Also, the inward-folded inner part 5 of the tube 1 is designed essentially circular in cross-section and approximately concentric to the outer part 3. Here, the weld 13 lies diametrically opposite the opening 7 (gap) of the inward-folded part 5.

Because of the shape of the cross-section of the tube 1 of known friction bolts, shown in FIG. 1 and previously described, which has the latter in the non-widened state, i.e., in the state in which it is inserted into a borehole before it is widened, areas of the inward-folded part 5 are produced that are undercut adjacent to the opening 7. These undercut areas have proven to be problematic.

Figure 2:
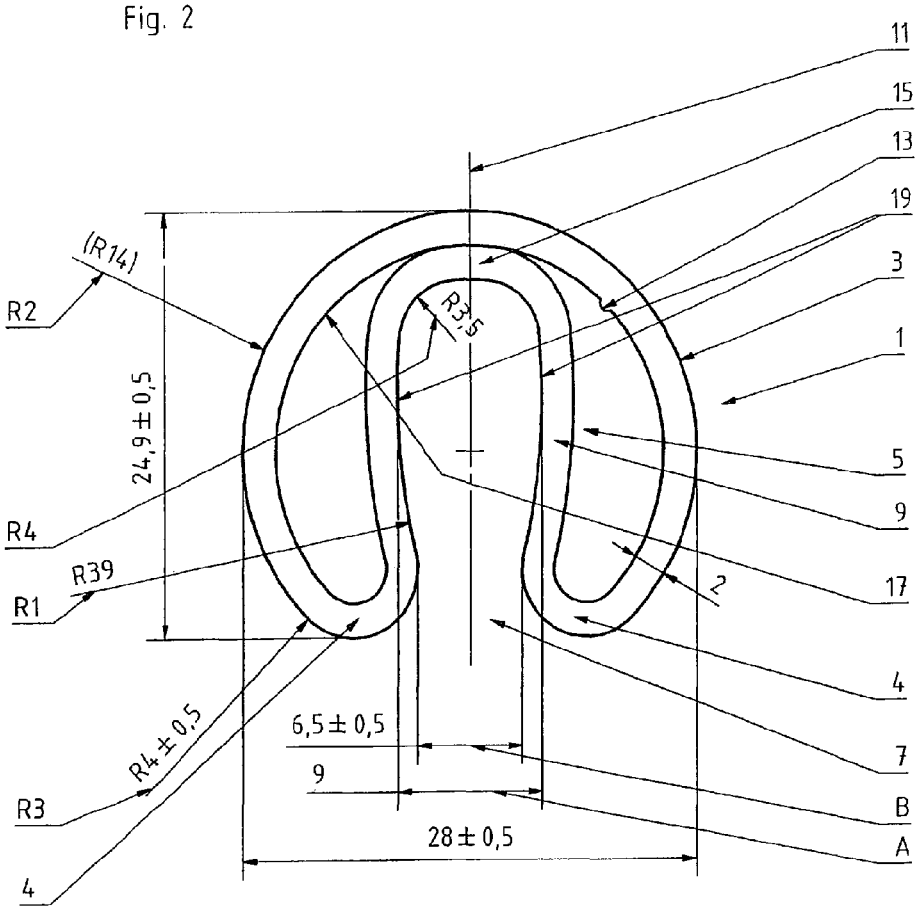
FIG. 2 shows the cross-sectional view of a friction bolt according to the invention (non-widened state).
Figure 3:
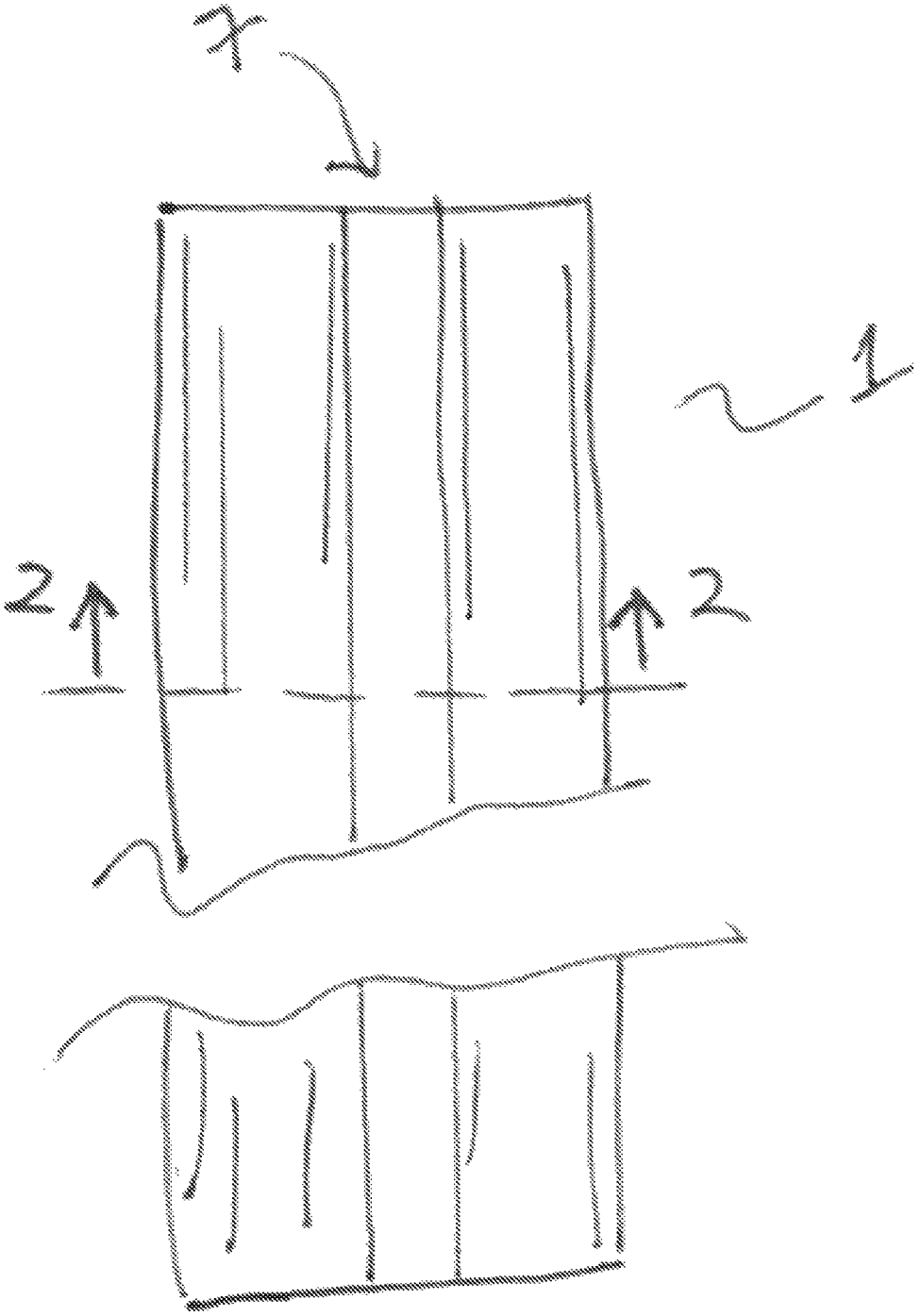
FIG. 3 shows the friction bolt tube in side view.

The tube 1, shown in FIGS. 2-3, for the friction bolt according to the invention has a cross-sectional shape, deviating from the cross-sectional shape of FIG. 1, of the inward-folded part 5, on the one hand, and the position of the longitudinal weld 13, on the other hand.

The inward-folded part 5 is no longer designed essentially concentric to the outer part 3 of the tube 1 as in the known tube 1, but rather deviates from this shape in the middle, i.e., in the plane of symmetry 11 of the tube 1. As a result, in connection to the opening 7, which also can be designed wider than in the known tube 1, less heavily concave lateral areas 9 of the inward-folded part 5 are produced. This has the result that areas of the inner part, which have undercuts in the known tube (FIG. 1), are not present.

In addition, the shape of the inward-folded part 5 produces larger radii of curvature (R3) in the inner part 5 in the transition areas 4 of the outer part 3 of the tube 1.

In the tube 1 of the friction bolt according to the invention, shown in FIG. 2, the bottom 15 of the inner part 5, i.e., the area that is opposite the opening 7 (gap) of the inward-folded part 5, rests from the inside on the inside surface 17 of the outer part 3.

Moreover, the weld 13 is laterally offset to the plane of symmetry 11 of the cross-sectional shape of the tube 1, such that the weld 13 is no longer arranged where the inner part 5 rests on the outer part 3 of the tube 1.

In the tube 1 of a friction bolt according to the invention, the radius R1 of the lateral wall areas 9 of the inward-folded part 5 of the tube 1 is greater than the radius R2 of the outer part 3 of the tube 1. In practice, the radius of curvature R1 of the lateral wall areas 9 of the inner part 5 of the tube 1 can be in the range of between at least 250% and 350%, in particular at least 280%, of the radius R2 of the outer part 3 of the tube 1.

In the tube 1 of the friction bolt according to the invention, the largest distance A that the interiors 19 of the lateral wall areas 9 of the inner part should be apart is at most equal to 120% to 160% of the width B of the opening or the gap 7. The largest distance A between the interiors 19 is at most equal to 140% of the width B of the gap 7.

In the tube 1 of the friction bolt according to the invention, as already mentioned, the radius of curvature R3 in the transition areas 4 from the outer part 3 into the inner part 5 of the tube 1 is larger than in the known tube (FIG. 1). In one embodiment, the radius R3 of the curvature of the wall of the tube 1 in the area 4 of the gap 7, where the outer part 3 turns into the inner part 5 of the tube 1, is at least equal to 20% to 40%, preferably at least equal to 30%, of the radius R2 of the outer part 3 of the tube 1.

With the tube 1 of the friction bolt according to the invention, it can also be provided that the radius R4 in the area of the bottom 15 of the inner part 5 of the tube 1 is at least equal to 15% to 35%, preferably at least equal to 25%, of the radius R2 of the outer part 3 of the tube 1.

In one exemplary embodiment, the distance A between the inner surfaces 19 of the lateral wall parts 9 of the inner part 5 is 9 mm, and the opening 7 has a width of 6.5±0.5 mm. The radius R2 of the outer part 3 of the tube 1 is 14 mm in the embodiment. The radius R1, with which the lateral wall parts 9 of the inner part 5 are curved, is 39 mm in the example. The radius, with which the transition areas 4 are curved from the outer part 3 into the inner part 5, i.e., the areas on both sides of the opening 7 or the gap 7, is 4±0.5 mm in the embodiment. Finally, the inner part 5 of the tube 1 can be curved in the bottom area 15 with a radius R4 of 3.5 mm.

In summary, an embodiment of the invention can be described as follows:

A tube 1 of a friction bolt has an outer part 3 and an inward-folded inner part 5 and a gap 7 that extends in the longitudinal direction of the tube 1, where the outer part 3 turns into the inner part 5 of the tube 1. The lateral wall areas 9 of the inner part 5 are designed flat and have a shape in which the free space between the outer part 3 and the inner part 5 is essentially lens-shaped as in known tubes. Moreover, the bottom 15 of the inner part 5 rests on the outer part 3 of the tube 1, and the weld 13 is arranged laterally offset relative to the plane of symmetry 11 as the area where the bottom 15 rests on the outer part 3 of the tube 1. Finally, the radii of curvature R3 in the area of the transitions 4 from the outer part 3 of the tube 1 into the inner part 5 of the tube 1 are designed larger than in the known tubes of this type.

The invention claimed is:

1. A friction bolt with a tube (1) that can be widened and that is folded inward in a longitudinal direction, the tube having a longitudinal plane of symmetry (11) running in the longitudinal direction, the tube comprising:

i) an outer part (3) with an essentially circular cross-sectional shape, the outer part (3) having a radius (R2);

ii) an inner part (5) arranged inside the outer part (3), the inner part (5) having lateral wall areas (9) with a radius of curvature (R1); and iii) a gap (7) that extends in the longitudinal direction of the tube (1), the outer part (3), in an area of the gap (7), turns into the inner part (5), wherein the lateral wall areas (9) extend from a shape concentric to the outer part (3) to the longitudinal plane of symmetry (11), wherein the radius of curvature (R1) of the lateral wall areas (9) is equal to 250% to 350% of the radius (R2) of the outer part (3), and wherein the tube (1) is a longitudinally-welded tube (1), with a weld (13) in the outer part (3) of the tube (1) arranged laterally offset relative to the longitudinal plane of symmetry (11) of the tube (1).

2. The bolt according to claim 1, wherein a bottom (15) of the inner part (5) joining the lateral walls areas (9) and located opposite the gap (7) rests on an inside surface (17) of the outer part (3) of the tube (1).

3. The bolt according to claim 2, wherein the bottom (15) in the longitudinal plane of symmetry (11) of the tube (1) rests on the outer part (3) of the tube (1).

4. The bolt according to claim 2, wherein a radius (R4) in the area of the bottom (15) of the inner part (5) of the tube (1) is equal to 15% to 35% of the radius (R2) of the outer part (3) of the tube (1).

5. The bolt according to claim 4, wherein the radius (R4) in the area of the bottom (15) of the inner part (5) of the tube (1) is equal to 25% of the radius (R2) of the outer part (3) of the tube (1).

6. The bolt according to claim 1, wherein the radius of curvature (R1) of the lateral wall areas (9) of the inner part (5) of the tube (1) is equal to 280% of the radius (R2) of the outer part (3) of the tube (1).

7. The bolt according to claim 1, wherein a largest distance (A) that interiors (19) of the lateral wall areas (9) of the inner part (5) of the tube (1) are apart is equal to 120% to 160% of a width (B) of the gap (7).

8. The bolt according to claim 7, wherein the largest distance (A) between the interiors (19) of the lateral wall areas (9) is equal to 140% of the width (B) of the gap (7).

9. The bolt according to claim 1, wherein a radius (R3) of the curvature of the wall of the tube (1) in the area of the gap (7) where the outer part (3) turns into the inner part (5) of the tube (1) is equal to 20% to 40% of the radius (R2) of the outer part (3) of the tube (1).

10. The bolt according to claim 9, wherein the radius (R3) of the curvature of the wall of the tube (1) in the area of the gap (7) where the outer part (3) turns into the inner part (5) of the tube (1) is equal to 35% of the radius (R2) of the outer part (3) of the tube (1).

11. The bolt according to claim 1, wherein a bottom (15) of the inner part (5) joining the lateral walls areas (9) and located opposite the gap (7) rests on an inside surface (17) of the outer part (3) of the tube (1).

12. A friction bolt with a tube (1) that can be widened and that is folded inward in a longitudinal direction, the tube having a longitudinal plane of symmetry (11) running in the longitudinal direction, the tube comprising:

an outer part (3) with an essentially circular cross-sectional shape, the outer part (3) having a radius (R2) along the circular cross-sectional shape;

an inner part (5) arranged inside the outer part (3) and free of undercuts, the inner part (5) having lateral wall areas (9) extending along the plane of symmetry, the lateral walls having a radius of curvature (R1), transition areas (4) turning the outer part (3) to the inner part (5), the transition areas (4) having a radius of curvature (R3); and a gap (7) in an area of the outer part (3) turning into to the inner part (5) and extending in the longitudinal direction of the tube (1), wherein the inner part (5) includes a bottom (15) joining the lateral walls areas (9) and located opposite the gap (7), the bottom (15) resting on an inside surface (17) of the outer part (3), the bottom having a radius of curvature (R4), wherein the radius of curvature (R1) of the lateral wall areas (9) is equal to 250% to 350% of the radius (R2) of the outer part (3) along the circular cross-sectional shape, and wherein the tube (1) is a longitudinally-welded tube (1), with a weld (13) in the outer part (3) of the tube (1) arranged laterally offset relative to the longitudinal plane of symmetry (11) of the tube (1).

13. The bolt of claim 12, wherein, the radius (R4) in the area of the bottom (15) of the inner part (5) is equal to 15% to 35% of the radius (R2) of the outer part (3).

14. The bolt according to claim 13, wherein the radius (R4) in the area of the bottom (15) of the inner part (5) is equal to 25% of the radius (R2) of the outer part (3).

15. A friction bolt with a tube (1) that can be widened and that is folded inward in a longitudinal direction, the tube having a longitudinal plane of symmetry (11) running in the longitudinal direction, the tube comprising:

an outer part (3) with an essentially circular cross-sectional shape, the outer part (3) having a radius (R2) along the circular cross-sectional shape;

an inner part (5) arranged inside the outer part (3) and free of undercuts, the inner part (5) having lateral wall areas (9) extending along the plane of symmetry, the lateral walls having a radius of curvature (R1), transition areas (4) turning the outer part (3) to the inner part (5), the transition areas (4) having a radius of curvature (R3); and a gap (7) in an area of the outer part (3) turning into to the inner part (5) and extending in the longitudinal direction of the tube (1), wherein the inner part (5) includes a bottom (15) joining the lateral walls areas (9) and located opposite the gap (7), the bottom (15) resting on an inside surface (17) of the outer part (3), the bottom having a radius of curvature (R4), and wherein the radius of curvature (R1) of the lateral wall areas (9) is equal to 250% to 350% of the radius (R2) of the outer part (3) along the circular cross-sectional shape, wherein, a distance (A) between inner surfaces (19) of the lateral wall parts (9) is 9 mm, the gap (7) has a width of 6.5±0.5 mm, the radius (R1) of the lateral wall areas (9) is 39 mm, the radius (R2) of the outer part (3) along the circular cross-sectional shape is 14 mm, the radius (R3) of the transition areas (4) are curved from the outer part (3) into the inner part (5) is 4±0.5 mm, and the radius (R4) of the bottom (15) is 3.5 mm.

* * * * *